US006050559A

United States Patent [19]

de Souza

[11] Patent Number: 6,050,559

[45] Date of Patent: Apr. 18, 2000

[54] BAR CLAMP FOR WOOD MANUFACTURING

[76] Inventor: Stephen de Souza, 735 Ocean Ave., Apt. 2A, Brookyln, N.Y. 11206

[21] Appl. No.: 09/133,983

[22] Filed: Aug. 14, 1998

[51] Int. Cl.[7] ..... B25B 1/02

[52] U.S. Cl. ..... 269/208; 269/283; 269/274; 269/275; 269/247

[58] Field of Search ..... 269/240–253, 269/279–284, 203–215, 274, 275, 285, 286

[56] References Cited

U.S. PATENT DOCUMENTS

| | | | |
|---|---|---|---|
| 307,439 | 11/1884 | Corbett | 269/208 |
| 1,823,537 | 9/1931 | Gaudreau | 269/242 |
| 3,575,405 | 4/1971 | Harding | 269/279 |
| 4,078,782 | 3/1978 | Carlson | 269/283 |
| 4,932,643 | 6/1990 | Rohm | 269/244 |
| 5,024,428 | 6/1991 | Ramsay | 269/279 |
| 5,415,651 | 5/1995 | Schmeiding | 269/208 |

*Primary Examiner*—Robert C. Watson
*Attorney, Agent, or Firm*—Robert M. Downey, P.A.

[57] ABSTRACT

The present invention provides a bar clamp made of light-weight parallel metal bars, e.g., aluminum, having movable or adjustable contacting attachment bodies which allow the clamp to be used for various applications. The bar clamp of the present invention is equipped with a measurement gauge for accurate attachment of the contacting attachment bodies to the workpiece. The parallel bars are separated and secured to each other by spacers and the bars have tracks along the inner faces of their entire length along which the attachment bodies move. One embodiment of the present invention discloses how the attachment bodies can be replaced by large frames having multiple attachment bodies mounted thereon for holding the workpiece in a vertical or horizontal position. Also, various designs of the attachment bodies which are interchangeable are provided.

9 Claims, 6 Drawing Sheets

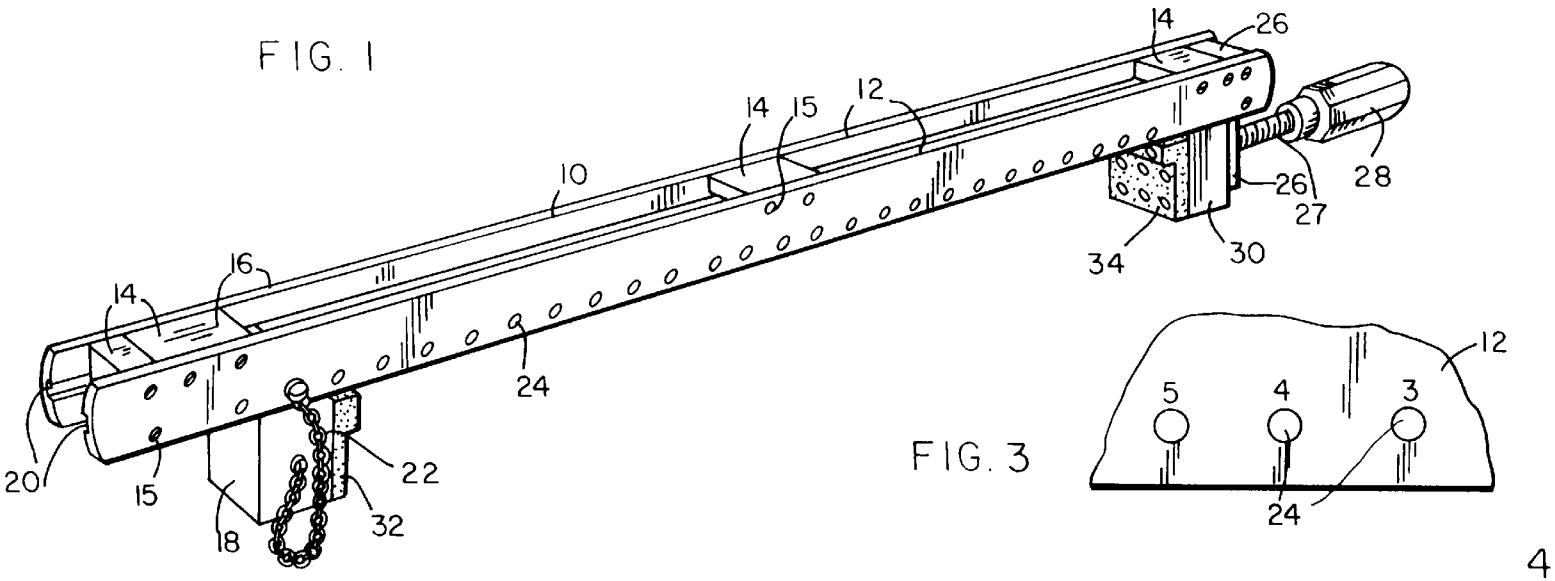
FIG. 1
FIG. 3
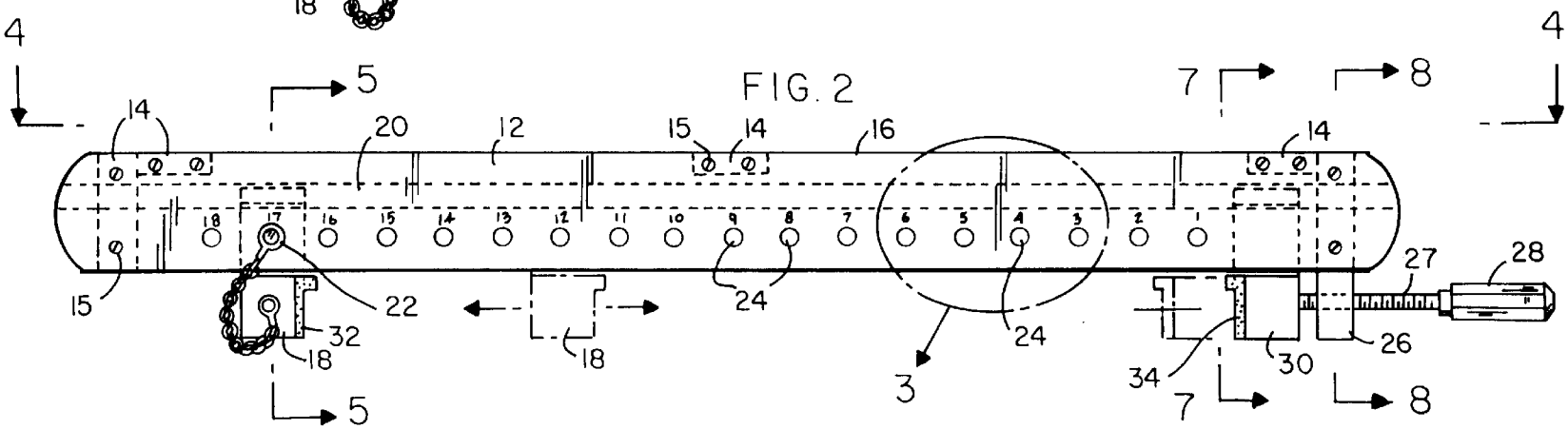
FIG. 2

FIG. 10
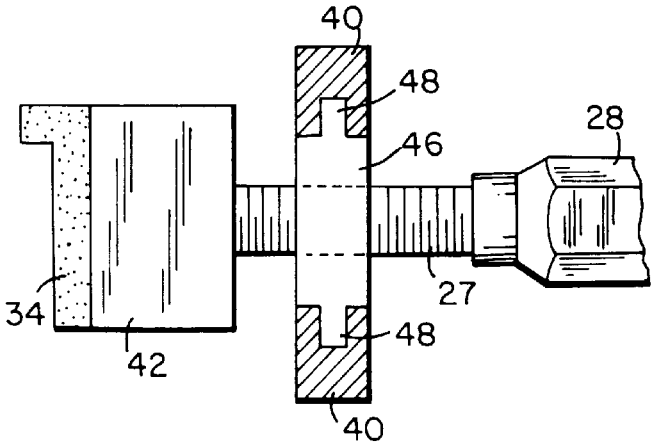
FIG. 12
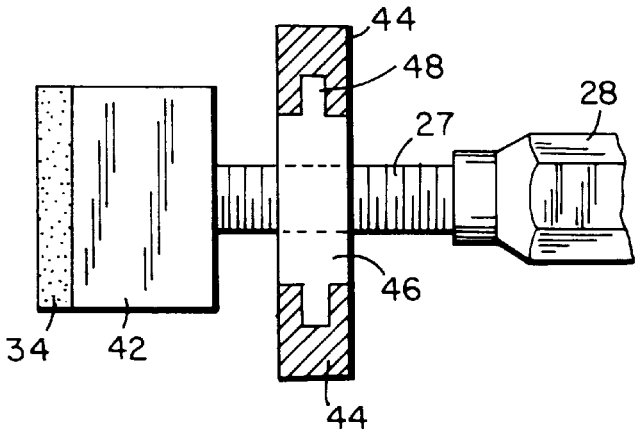
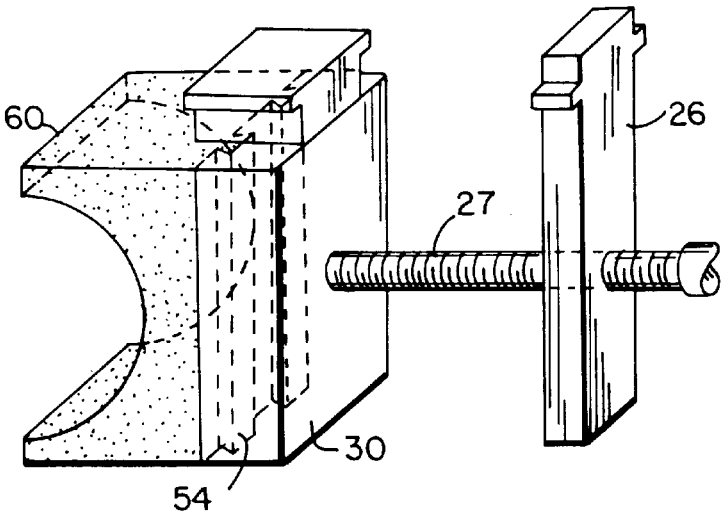
FIG. 17

FIG. 13
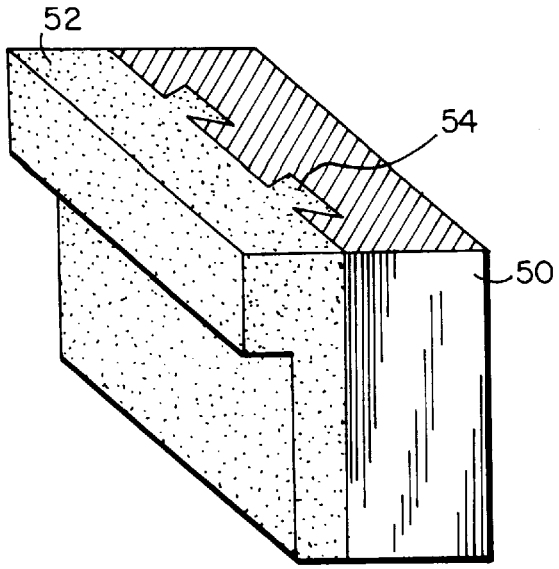
FIG. 14
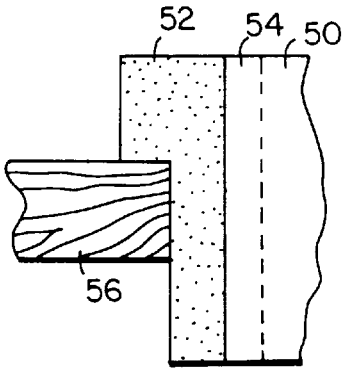
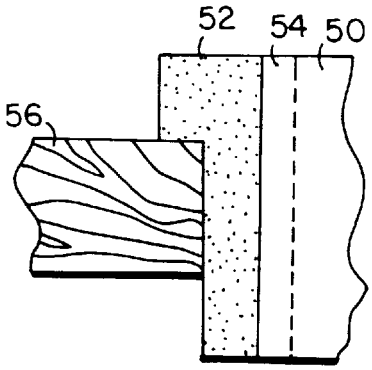
FIG. 15
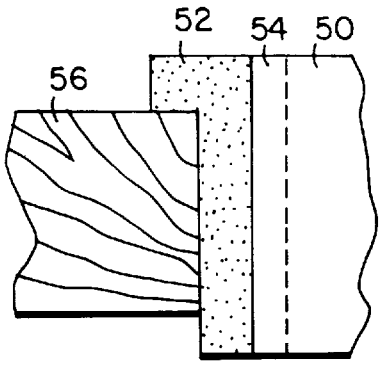
FIG. 16

BAR CLAMP FOR WOOD MANUFACTURING

BACKGROUND OF THE INVENTION

1. Field of the Invention

The present invention generally relates to clamping devices for woodworking and, more particularly, is concerned with a bar clamp device for use in wood manufacturing having adjustable clamping attachment bodies which are adaptable for various clamping applications.

2. Description of the Prior Art

Numerous woodworking clamps have been described in the prior art. While these woodworking clamps may have been suitable for the purpose for which they were designed, they would not be suitable for the purposes of the present invention as heretofore described. Thus, it is desirable to provide a woodworking clamp useful in wood manufacturing which has removable attachments useable for various clamping applications.

The following are clamping devices used in the woodworking industry.

Hand screws, or wooden parallel clamps, are holding devices for wood, plastic, and many other materials. They can be used on finished surfaces without any protective wood strips. They are made in sizes ranging from an opening between jaws of about 2" to an opening between jaws of about 17". When using a hand screw, the center spindle is held in the left hand and the end spindle in the right hand. Then the hand screw can be opened or closed by twisting the handles in opposite directions.

Bar clamps or cabinet clamps of steel or aluminum are used primarily for edge-to-edge gluing, for clamping up large surfaces, and for assembling furniture. Common lengths are from 2' to 10'. One end is adjusted by a friction clutch or catch while the other end has a screw for applying pressure. When using bar clamps, the screw should be turned out completely. The friction clutch or catch is moved until the clamp is slightly wider than the total width of the stock to be clamped. The clamp is then tightened by turning the screw. When using bar clamps on finished stock, as in assembling furniture, the surface of the wood must be protected. Normally clamp pads or pieces of scrap stock are placed between the jaws and the wood.

Pipe clamps are similar to bar clamps. Instead of a metal bar, the screw and the friction clutch are mounted on plumbing pipe that is threaded at the ends.

Spring clamps are used for many kinds of clamping. They look like oversize clothespins. They are particularly good when tight pressure is all that is needed or when the clamp must be applied and removed quickly. Some have rubber-covered jaws to protect the workpiece. There is a heavy-duty type that has pivoting jaws made of stainless steel with double rows of serrated teeth along the pressure edge. Such jaws can hold parts at any angle so that miter joints and other odd-shaped pieces can be clamped together easily.

C-clamps, or carriage clamps, are made in a wide variety of sizes and shapes and are commonly used when gluing stock face to face. The maximum opening sizes vary from about 2" to 12". Some C-clamps are made with an extra deep throat which gives maximum working clearance. When clamping a finished surface with C-clamps, always use cauls to protect the surface.

Quick clamps, which do the work of heavy C-clamps, are similar to short bar clamps, and can be adjusted by sliding the head along the bar. An edge-clamp fixture works with a quick clamp to help solve a common and difficult problem: gluing strips of wood to the edges of plywood or solid wood. The quick clamp grasps the work, and the edge clamp applies pressure to the edge material.

Band clamps are made with a metal clamp and a band of steel or canvas. They are used primarily for clamping round or irregularly shaped sections such as furniture frames. Steel bands are best for round objects, while canvas bands are better for odd shapes.

Hinged clamps fasten to the underside of a bench and are easily swung out of the way when not in use. They can be used for many types of gluing and clamping operations.

The 3-way edging clamp allows the "right angle" screw to be centered or positioned above or below the center on various thicknesses of material.

Several different types of clamps and jigs are available for gluing up meter joints and frames. The miter-and-corner clamp is ideal for assembling frames. Once the two parts are clamped together, the corner can be trued up with a backsaw if it doesn't fit properly. Since the corner is open, any kind of metal fastener can be installed easily.

A miter clamp for use with a hand screw is made of pieces of hardwood. This clamping jig is used for assembling many different sizes of frames and the clamp applies uniform pressure to all four joints at the same time. It leaves the joints visible so that you can make sure they are straight and tight. Frame clamps for larger jobs are also available.

Consequently, as can be seen from a review of the prior art, a need exists for an improved clamp for woodworking which has adjustable wood holding attachments whereby the clamp can be adapted to be used for multiple applications.

SUMMARY OF THE PRESENT INVENTION

The present invention provides a bar clamp made of lightweight parallel metal bars, e.g., aluminum, having movable or adjustable wood contacting attachment bodies which allow the clamp to be used for various applications. The bar clamp of the present invention is equipped with a measurement gauge for accurate attachment of the contacting attachment bodies to the workpiece. The parallel bars are separated and secured to each other by spacers and the bars have tracks along the inner faces of their entire length along which the attachment bodies move. One embodiment of the present invention discloses how the attachment bodies can be replaced by large frames having multiple attachment bodies mounted thereon for holding the workpiece in a vertical or horizontal position. Also, various designs of the attachment bodies which are interchangeable are provided.

An object of the present invention is to provide a bar clamp made of light metal, namely, aluminum, which makes them lightweight and easier to handle as opposed to existing bar clamps which usually are of heavy metal which makes them heavy weight.

Furthermore, existing bar clamps are constructed with fixed non-movable tightening attachments limiting their usage to specific applications. Therefore, for different kinds of clamping applications, different lengths and kinds of existing bar clamps have to be used, either for regular clamping, width or depth clamping. An advantage of the bar clamp of the present invention is that it is constructed to have removable and/or adjustable attachment bodies which can be used for different clamping applications, either for regular, width (horizontal), or depth (vertical) clamping. Also, another advantage of the removable attachment bodies is that the attachments are designed with a dovetail tongue and groove attachment means for the hard rubber face pieces of different shapes and sizes for different clamping applications.

Another advantage of the new bar clamp of the present invention is a measurement gauge built onto the bar. The measurements are in inches (measurements could also be in centimeters) each 1" apart (or 1 cm apart) and each clamp has the measurement gauge according to the length of each bar clamp. The measurement gauge is calculated between the tightening attachment pieces. Moreover, at each 1" point of measurement, a hole is located on the bar and on the movable tightening attachment through which a metal pin is inserted to hold the movable tightening attachment piece in the desired measurement location. Existing bar clamps not having a measurement gauge, will necessitate adjusting each individual clamp onto the workpiece itself before tightening. However, with the new designed bar clamp, the clamp can be set to the measurement desired, using the measurement gauge, prior to fitting and tightening onto the workpiece.

Another advantage of the present invention is that it is constructed of two straight bars, approximately 1½" apart, held by brace pieces. This feature allows the clamp to be used "upside down" for clamping without "falling over." Existing bar clamps have only a single bar and for this method of clamping, since existing bar clamps have only a single bar, a wooden block with a groove is used to support the clamp in an "upside down" position, otherwise it will "fall over."

The foregoing and other objects and advantages will appear from the description to follow. In the description, reference is made to the accompanying drawings, which forms a part hereof, and in which is shown by way of illustration specific embodiments in which the invention may be practiced. The embodiments will be described in sufficient detail to enable those skilled in the art to practice the invention, and it is to be understood that other embodiments may be utilized and that structural changes may be made without department from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

FIG. 1 is a perspective of the present invention;

FIG. 2 is an elevation side view of the present invention;

FIG. 3 is a partial elevation view taken from FIG. 2 showing a portion of the bar of the present invention;

FIG. 10 is a cross-sectional view taken along line 10—10 of FIG. 9;

FIG. 12 is a cross-sectional view taken along line 12—12 of FIG. 11;

FIG. 13 is a perspective of a clamping attachment;

FIG. 14 is a side elevation view of an embodiment of the clamping attachment;

FIG. 15 is a side elevation view of an embodiment of the clamping attachment;

FIG. 16 is a side elevation view of an embodiment of the clamping attachment;

FIG. 17 is a perspective of an embodiment of the clamping attachment.

DESCRIPTION OF THE PREFERRED EMBODIMENTS(S)

Figure 4:
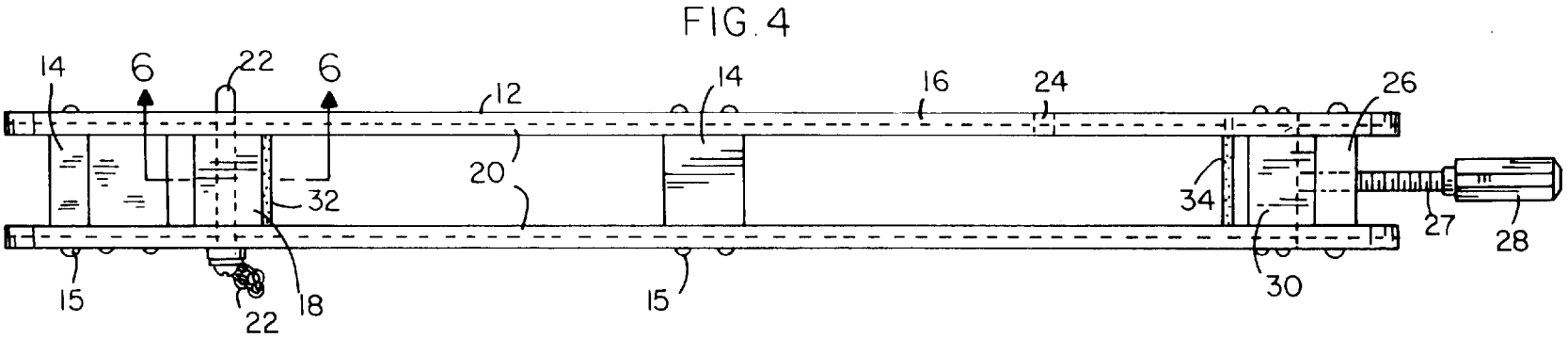
FIG. 4 is a plan view of the present invention.

Turning to FIG. 1, therein is shown a perspective view of the present invention shown generally at 10 being a pair of elongated, straight parallel bars 12, attached and secured to each other by multiple brace or spacer pieces 14, located near the ends and middle of the bar 12, for maintaining, strengthening, and attaching the bars to each other to be approximately 1.5 inches apart. The spacer pieces 14, are attached to the bars 12, using fastening means 15, such as screws or nuts and bolts. The bars 12 are composed of lightweight material, such as, aluminum or like material. The top surfaces 16 of the bar 12 and spacers 14 form a flat top surface which is a major advantage of the present invention over the prior art because the flat top surface 16 allows the clamp 10 to be used upside down, i.e., rested on what would normally be the top surface 16, without falling over which occurs with other bar clamps because they are made of round bars which have no flat top surface.

Also shown therein are the movable or sliding clamping or tightening attachment bodies 18 which are slidably attached to the bars 12, in slots or tracks 20, on the opposing inner surfaces or faces of each parallel bar 12. The movable attachments 18, which are adjustable over almost the entire length of the bars 12, slidably operate in the tracks 20 and are fastened in place along the bar using a pin and chain device or means 22, with the pin 22, being inserted into the hole 24, spaced horizontally along the parallel bars 12 at one inch intervals. These movable attachments 18 are another advantage of the present invention over the prior art which has fixed attachments as previously discussed. Also, the holes 24 serve as a measuring gauge for the bar 12 to be more easily and quickly fitted to the workpiece. Also shown is a threaded "t" shaped spacer 26, through which the threaded tightening rod 27, and handle 28, passes and rotatably connects to another second slidably mounted attachment body 30, which also slides in the same track 20, as does the first slidable attachment body 18. The second tightening attachment 30 which is not moved a great distance down the bar but is moved and is threadably adjustable as a result of turning the threaded rod 27, is the attachment which is actually manually adjusted by turning handle 28, which allows the attachments 18 and 30, to tightly grip the workpiece. Also shown are "L" shaped hard rubber attachment faces 32, on the first tightening attachment 18, and face 34, on the second tightening attachment 30.

Turning to FIG. 2, a side view in elevation of the present invention is shown with the parallel bars 12, the spacer pieces 14, the fastening means 15, of the spacer pieces, the top surface of the bars 16, the first tightening attachment 18, the tracks of the bars 20, the pin and chain 22, the holes in the bar 24, the "t" shaped spacer 26, the threaded rod 27, and handle 28, the second tightening attachment 30, and the "L" shaped attachment faces 32 and 34.

In FIG. 3, there is shown a section view of the holes 24, which are spaced one inch apart along the length of the bars 12.

A plan view of the present invention is shown in FIG. 4, illustrating the parallel bars 12, the spacer pieces 14, the fastening means 15, of the spacer pieces, the top surface of the bars 16, the first tightening attachment 18, the tracks of the bars 20, the pin and chain 22, the holes in the bar 24, the "t" shaped spacer 26, the threaded rod 27, and handle 28, the second tightening attachment 30, and the "L" shaped attachment faces 32 and 34.

Figure 5:
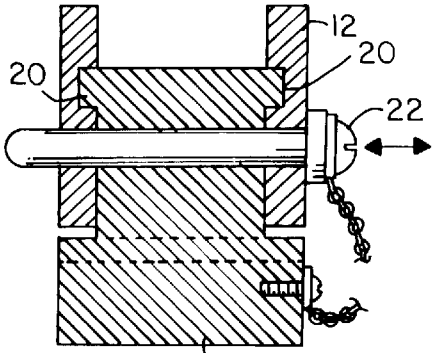
FIG. 5 is a cross-sectional view of the movable attachment taken along line 5—5 of FIG. 2.

In FIG. 5, a cross-sectional view is shown of the movable attachment taken along line 5—5 of FIG. 2. Shown therein are the bars 12, the movable attachment 18, the sliding tracks 20, of the bar, and the pin and chain 22.

Figure 6:
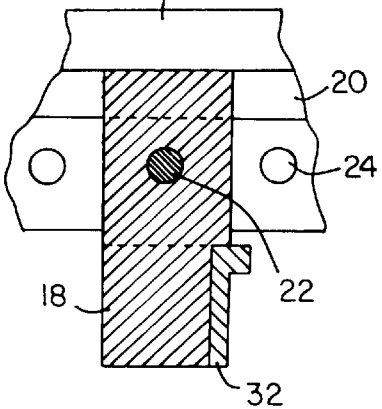
FIG. 6 is a cross-sectional view of the movable attachment taken along line 6—6 of FIG. 4.

Turning to FIG. 6, a cross-sectional view is shown of the movable attachment taken along line 6—6 of FIG. 4. Shown therein is the bar 12, holes 24, the movable attachment 18, the sliding track 20 of the bar, the pin 22, and the "L" shaped attachment face 32.

Figure 7:
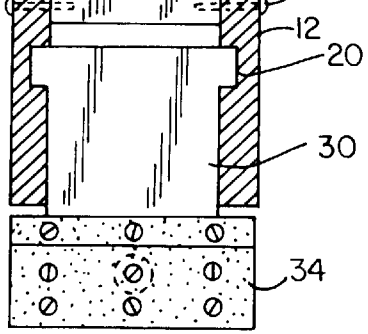
FIG. 7 is a cross-sectional view of the present invention taken along line 7—7 of FIG. 2.

A cross-sectional view of the present invention is shown in FIG. 7, illustrating the bars 12, the space piece 14, with fastening means 15, the sliding track 20, and the second movable attachment 30 with its "L" shaped attachment face 34.

Figure 8:
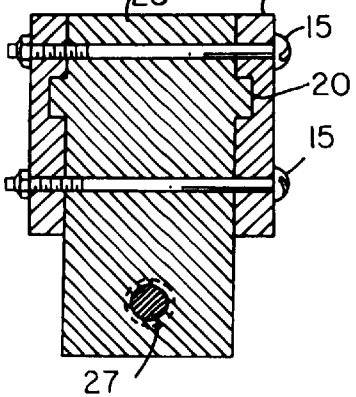
FIG. 8 is a cross-sectional view of the "T" shaped spacer taken along line 8—8 of FIG. 2.

FIG. 8 shows a cross-sectional view of the "T" shaped spacer taken along line 8—8 of FIG. 2. Therein is shown the bars 12, the "T" shaped spacer 26, the sliding track 20, fastening means 15, and the threaded rod 27.

Figure 9:
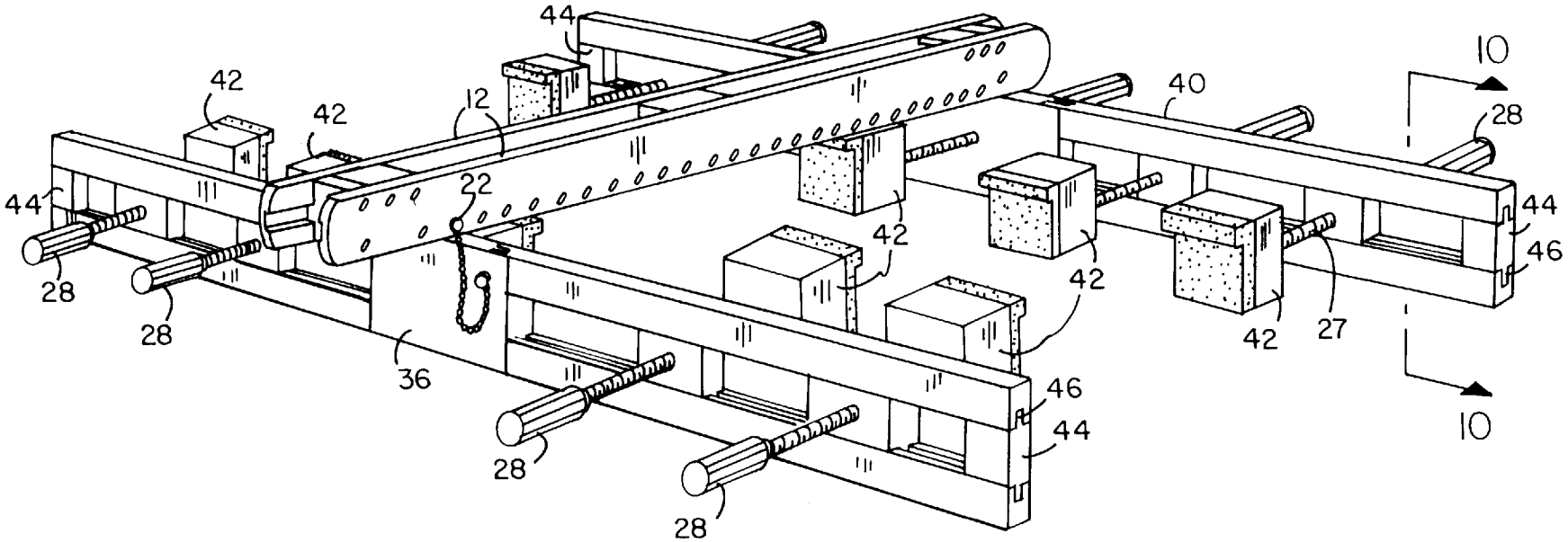
FIG. 9 is a perspective view of the present invention shown in connection with a horizontal clamping attachment.

Referring to FIG. 9, there is shown a perspective view of the present invention shown in operative connection with a horizontal clamping frame or attachment having replaced the attachment bodies. Shown therein are the bars 12, having the first tightening attachment referred to in the previous drawing as 18, replaced by a first horizontal clamping attachment 36, which is attached to the bar assembly 12 by a pin and chain 22, and which operates by sliding in the bar assembly just as did the first movable tightening attachment 18. Also shown is the second threadably adjustable horizontal clamping attachment 40 which is attached to the bar assembly 12 just as was the "T" shaped spacer 26 (not shown) which was previously described with FIG. 2. Both the first horizontal clamping attachment 36 and the second horizontal clamping attachment 40 include multiple attachment bodies 42 slidably attached thereto with threaded rod 27 and handles 28 for tightening the attachments 42. Note that the members 36 and 40 are made with removable end braces 44 wherein the end braces 44 are manufactured with tongue and groove fastening means 46 or any suitable fastening means to be easily removable from the members 36 and 40 for modifying the number or type of tightening attachments 36, 42.

In FIG. 10, a cross-sectional view taken along line 10—10 of FIG. 9 is shown with the horizontal clamping frame attachment 40, the adjustable clamping attachment 42, the tightening rod 27 and handle 28 the slidable mounting piece 46, the tracks 48 in which the piece slides, and the "L" shaped attachment face 34. The first horizontal clamping attachment 36 is essentially identical.

Figure 11:
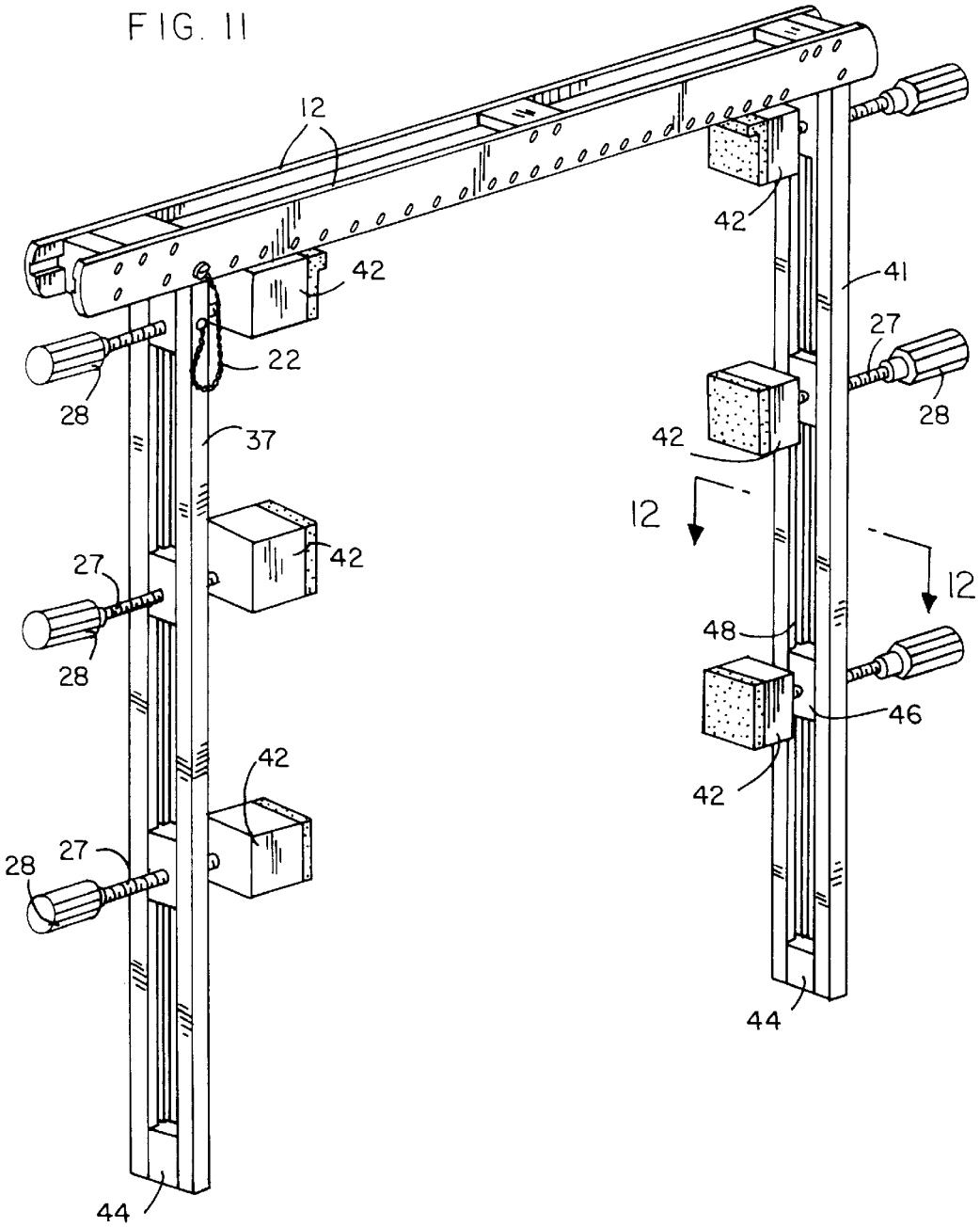
FIG. 11 is a perspective view of the present invention shown in connection with a vertical clamping attachment.

Turning to FIG. 11, therein is shown a perspective view of the present invention shown in operative connection with a vertical frame member clamping attachment. Shown therein are the bars 12, having the first tightening attachment referred to in the previous drawing as 18, replaced by a vertical clamping attachment 37, which is attached to the bar assembly 12 by a pin and chain 22, and operates by sliding in the bar assembly just as did the first movable tightening attachment 18 (not shown). The vertical clamping attachment 37 is made of metal or like material and comprised an assembly having multiple attachment bodies 42 with threaded rod 27 and handles 28 which are slidably attached in the mounting pieces 46, in tracks, along the vertical clamping attachment 37. Also shown is the second vertical clamping attachment 41 which is attached to the bar assembly 12 just as was the "T" shaped spacer 26 (not shown) which was previously described with FIG. 2. The second horizontal clamping attachment 41 has multiple attachments 42 slidably attached in the mounting pieces 46, the tracks 48, with threaded rod 27 and handles 28 for tightening the attachments 42. Note that the members 37 and 41 are made with removable end braces 44 similar to FIG. 9.

FIG. 12 shows a cross-sectional view taken along line 12—12 of FIG. 11 illustrating the vertical clamping frame member attachment 41, the adjustable clamping attachment 42, the tightening rod 27 and handle 28, the slidable mounting piece 46, the tracks 48 in which the piece 46 slides, and the "L" shaped attachment face 34.

Referring to FIG. 13, there is shown a perspective of a tightening attachment 50 which operates as previously discussed, for example, see item 30 of FIG. 4, showing a removably mounted attachment face 52 having a dovetail or like mounting means 54. The tightening attachment 50 would be made of metal or like material, and the attachment face 52 would be made of hard rubber or like material. The dovetail mounting means 54 allows alternative sizes, shapes and designs of faces 52 to be easily interchanged and attached to the tightening attachments 50.

FIGS. 14, 15 and 16 show side elevation views of the tightening attachment 50 of FIG. 13 illustrating alternate designs of attachment faces 52, the dovetail mounting means 54, and the workpiece 56.

Finally, FIG. 17 shows a perspective of an alternative embodiment of the tightening attachment as previously shown, for example, see item 30 of FIG. 2. In particular, a clamping attachment 30 is shown having an attachment face 60 of a bullnose design. Also shown is the "T" shaped spacer 26, the threaded rod 27, and the dovetail attachment means 54.

While the present invention has been shown and described in accordance with preferred and practical embodiments thereof, it is recognized that departments made be made from the instant disclosure which, therefore, should not be limited except within the scope of the following claims as interpreted under the doctrine of equivalents.

What is claimed is:

1. A woodworking apparatus comprising:

a pair of elongated parallel members;

said pair of members being secured to each by multiple spacers;

a pair of slidably mounted clamping bodies mounted on said pair of members;

a pair of slotted tracks on opposing faces of said elongated members within which said pair of clamping bodies slidably operate;

means on said pair of elongated members for measuring the distance between said pair of slidably mounted clamping bodies, and including a plurality of holes positioned at graduated intervals along said pair of elongated parallel members;

said pair of clamping bodies further including a first clamping body being slidable along said slotted tracks and being selectively and adjustable positionable at said graduated intervals of said elongated parallel members, and a second clamping body being threadably adjustable along said pair of slotted tracks and being selectively and adjustably positionable along said elongated parallel members; and means for securing said first and second clamping bodies to said pair of elongated parallel members at a plurality of selected, adjusted positions.

2. The apparatus of claim 1 wherein said clamping bodies have a face for contacting the workpiece.

3. The apparatus of claim 2 wherein said face is "L" shaped.

4. The apparatus of claim 2 wherein said face is flat shaped.

5. The apparatus of claim 2 wherein said face is bullnose shaped.

6. The apparatus of claim 2 wherein said face further comprises hard rubber.

7. The apparatus of claim 2 wherein said face further comprises metal.

8. The apparatus of claim 2 wherein said face further comprises dovetail attaching means for mounting said face to said clamping body.

9. A woodworking apparatus comprising:

a pair of elongated parallel members;

multiple spacers for securing said pair of elongated parallel members to each other;

a pair of slidably mounted bodies mounted on said pair of elongated parallel members;

means on said pair of elongated parallel members for measuring the distance between said pair of slidably mounted bodies, and including a plurality of holes positioned at graduated intervals along said pair of elongated parallel members;

said pair of slidably mounted bodies further comprising a first and second frame member having multiple clamping bodies mounted thereon;

said multiple clamping bodies being slidably mounted on said first and second frame member;

a pair of slotted tracks on opposing faces of said elongated members within which said pair of bodies slidably operate;

said pair of bodies further including a first body being slidably and selectively positionable along said graduated intervals of said elongated parallel members, and a second body being threadably adjustable along said elongated parallel members; and means for securing said first and second bodies to said pair of parallel members at a plurality of selected, adjusted positions.

* * * * *